US006364282B1

(12) United States Patent
Ausman et al.

(10) Patent No.: US 6,364,282 B1
(45) Date of Patent: Apr. 2, 2002

(54) HYDRAULICALLY ACTUATED FUEL INJECTOR WITH SEATED PIN ACTUATOR

(75) Inventors: Thomas G. Ausman, Metamora; Steven Y. Tian, Bloomington, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/358,990

(22) Filed: Jul. 22, 1999

Related U.S. Application Data

(60) Provisional application No. 60/110,897, filed on Dec. 4, 1998.

(51) Int. Cl.[7] ..... F02M 59/46; F02M 57/02

(52) U.S. Cl. ..... 251/129.16; 123/446

(58) Field of Search ..... 123/447, 446; 251/129.16, 282; 137/625.65; 239/585.1, 585.3

(56) References Cited

U.S. PATENT DOCUMENTS

| | | | | |
|---|---|---|---|---|
| 4,603,671 A | | 8/1986 | Yoshinaga et al. | 123/467 |
| 5,176,120 A | | 1/1993 | Takahashi | 123/467 |
| 5,438,968 A | | 8/1995 | Johnson et al. | 123/446 |
| 5,497,750 A | | 3/1996 | Mueller et al. | 123/446 |
| 5,518,030 A | | 5/1996 | Liu et al. | |
| 5,641,148 A | * | 6/1997 | Pena et al. | 251/129.18 |
| 5,664,545 A | * | 9/1997 | Kato et al. | 123/496 |
| 5,669,355 A | | 9/1997 | Gibson et al. | 123/446 |
| 5,738,075 A | | 4/1998 | Chen et al. | |
| 6,076,800 A | * | 6/2000 | Heinz et al. | 251/129.06 |
| 6,102,004 A | * | 8/2000 | Cowden et al. | 123/446 |

FOREIGN PATENT DOCUMENTS

EP 0 686 764 A2 12/1995

* cited by examiner

*Primary Examiner*—Henry C. Yuen
*Assistant Examiner*—Arnold Castro
(74) *Attorney, Agent, or Firm*—Eric M. Bram; Michael B. McNeil

(57) ABSTRACT

An actuation fluid control valve for a hydraulically actuated fuel injector has a valve body having an inlet seat, a bore having a bore axis and a bore wall, an actuation control cavity, a low pressure actuation fluid drain, an actuation fluid inlet for admitting high pressure actuation fluid to the bore from outside the fuel injector, an inlet seat at a border between the actuation control cavity and the bore, and a drain seat at a border between the actuation control cavity and the actuation fluid drain. An actuator is attached with the valve body. An actuation valve member has an inlet pin surface partially defining a fluid entry chamber within the bore and is slidably disposed in the bore in response to the actuator between a first position in which the actuation control cavity is open to the actuation fluid inlet via the fluid entry chamber and the actuation valve member is being held against the drain seat such that the actuation control cavity is fluidly isolated from the actuation fluid drain, and a second position in which the actuation control cavity is open to the actuation fluid drain and the actuation valve member is being held against the inlet seat such that the actuation control cavity is fluidly isolated from the actuation fluid inlet.

21 Claims, 9 Drawing Sheets

HYDRAULICALLY ACTUATED FUEL INJECTOR WITH SEATED PIN ACTUATOR

RELATION TO OTHER PATENT APPLICATIONS

This application claims the benefit of co-pending provisional application Ser. No. 60/110,897, filed Dec. 4, 1998, with the same title as above.

TECHNICAL FIELD

The present invention relates generally to fuel injection, and more particularly to hydraulically actuated fuel injectors with direct control check valve members, and fuel injection systems and methods using same.

BACKGROUND

Known hydraulically actuated fuel injection systems and/or components are shown, for example, in U.S. Pat. No. 5,121,730 issued to Ausman et al. on Jun. 16, 1992; U.S. Pat. No. 5,271,371 issued to Meints et al. on Dec. 21, 1993; and U.S. Pat. No. 5,297,523 issued to Hafner et al. on Mar. 29, 1994. In these hydraulically actuated fuel injectors, a spring biased check valve member opens to commence fuel injection when pressure is raised by an intensifier piston/plunger assembly to a valve opening pressure. The intensifier piston is acted upon by a relatively high pressure actuation fluid, such as engine lubricating oil, when a solenoid driven actuation fluid control valve opens the injector's high pressure inlet. Injection is ended by deactivating the solenoid to release pressure above the intensifier piston. This in turn causes a drop in fuel pressure causing the check valve member to close under the action of its return spring and end injection.

A hydraulically actuated fuel injector with a direct-control check valve is taught U.S. Pat. No. 5,738,075 issued to Chen et al. on Apr. 14, 1998. In a Fuel injector with a direct-control check valve, high pressure actuation fluid is also diverted to a check control chamber where it exerts pressure on a closing hydraulic surface of the check valve member. Since the direct-control check valve generally has a much faster response time than the actuation fluid control valve, the direct-control check valve can be used to more quickly close, or alternately and very quickly open and close, the check valve member, before the drop in fuel pressure occurs.

Operation of this type of hydraulically actuated fuel injector is illustrated in FIGS. 2–4, in which a single two-way actuator controls both the actuation fluid control and direct check control by exploiting a hysteresis (delayed) effect in an actuation fluid control valve versus the quick response of a check valve member in a check control valve. This fuel injector 101 utilizes a single two-way solenoid 130 to alternately open an intensifier control passage 109 to an actuation fluid inlet 106 or a low pressure actuation fluid drain 104, and uses the same solenoid 130 to control the exposure of a check control chamber 118 to the actuation fluid inlet 106 or the actuation fluid drain 104.

The injector 101 includes an injector body 105 having the actuation fluid inlet 106 connected to a branch rail passage, an actuation fluid drain 104 connected to the actuation fluid re-circulation line, and a fuel inlet 120 connected to a fuel supply passage. The injector 101 includes a hydraulic means for pressurizing fuel within the injector during each injection event and a check control valve that controls the opening and closing of a nozzle outlet 117.

The hydraulic means for pressurizing fuel includes an actuation fluid control valve that includes the two-way solenoid 130 attached to a pin 135. An intensifier spool valve member 140 responds to movement of the pin 135 and a ball valve member 136 to alternately open the intensifier control passage 109 to the actuation fluid inlet 106 or the low pressure drain 104. The intensifier control passage 109 opens to a stepped piston bore 110, 115 within which an intensifier piston 150 reciprocates between a return position (illustrated in FIGS. 2 and 3) and a forward position (not shown).

The injector body 105 also includes a plunger bore 111, within which a plunger 153 reciprocates between a retracted position (illustrated in FIGS. 2 and 4) and an advanced position (not shown). Portions of the plunger bore 111 and the plunger 153 define a fuel pressurization chamber 112, within which fuel is pressurized during each injection event. The plunger 153 and the intensifier piston 150 are returned to their retracted positions between injection events under the action of a compression spring 154.

Thus, the hydraulic means for pressurizing fuel includes the fuel pressurization chamber 112, plunger 153, intensifier piston 150, actuation fluid inlet 106, intensifier control passage 109, and the various components of the actuation fluid control valve, which includes the solenoid 130, ball valve member 136, pin 135, and intensifier spool valve member 140, etc.

Fuel enters the injector 101 at the fuel inlet 120 and travels past a ball check 121, along a hidden fuel supply passage 124, and into the fuel pressurization chamber 112, when the plunger 153 is retracting. The ball check 121 prevents a reverse flow of fuel from the fuel pressurization chamber 112 into the fuel supply passage 124 during the plunger's downward stroke. Pressurized fuel travels from the fuel pressurization chamber 112 via a connection passage 113 to a nozzle chamber 114. A check valve member 160 moves within the nozzle chamber 114 between an open position in which the nozzle outlet 117 is open and a closed position in which the nozzle outlet 117 is closed.

The check valve member 160 includes a lower check portion 161 and an intensifier portion 162 separated by spacers 164 and 166, and is mechanically biased to its closed position by a compression spring 165 compressed between the spacer 164 and the intensifier portion 162. Thus, when the check valve member 160 is closed and the check control chamber 118 is open to low pressure, the intensifier portion 162 is pushed to its upper stop.

The check valve member 160 includes opening hydraulic surfaces 163 exposed to fluid pressure within the nozzle chamber 114, and a closing hydraulic surface 167 exposed to fluid pressure within the check control chamber 118. The closing hydraulic surface 167 and the opening hydraulic surfaces 163 are sized and arranged so that the check valve member 160 is hydraulically biased toward its closed position when the check control chamber 118 is open to a source of high pressure fluid. Thus, there should be adequate pressure on the closing hydraulic surface 167 to keep the nozzle outlet 117 closed despite the presence of high pressure fuel in nozzle chamber 114 that may be otherwise above a valve opening pressure. The opening hydraulic surfaces 163 and closing hydraulic surface 167 are also preferably sized and arranged such that check valve member 160 is hydraulically biased toward its open position when the check control chamber 118 is connected to a low pressure passage and the fuel pressure within nozzle chamber 114 is greater than the valve opening pressure.

In the actuation fluid control valve area of the fuel to injector 101, the two-way solenoid 130 is attached to a pin 135. With the repulsive solenoid 130 de-energized, the pin 135 is pushed to a retracted position as the hydraulic force of the high pressure hydraulic fluid pushes the ball valve member 136 against an upper seat 172. In this position, high pressure actuation fluid can flow past a lower seat 173 and into contact with an end hydraulic surface 141 of the intensifier spool valve member 140. The force of the high pressure hydraulic fluid against the end hydraulic surface 141 balances the force of the high pressure hydraulic fluid against a bottom end of the spool valve member 140 so that a compression spring 145 can push the spool valve member 140 to its lower position.

When the spool valve member 140 is at its lower position the intensifier control passage 109 is blocked from receiving high pressure hydraulic fluid from a spool valve interior 147 past a high pressure access seat 171, but instead is open to actuation fluid drain 104 past a drain access seat 170.

When the solenoid 130 is energized, the pin 135 moves downward causing the ball valve member 136 to open the upper seat 172 and close the lower seat 173. This causes the end hydraulic surface 141 to be exposed to the low pressure in drain passage 129, which is connected to a second drain 108. This creates a hydraulic imbalance in intensifier spool valve member 140 causing it to move upward against the action of compression spring 145 to close the drain access seat 170 and open the high pressure access seat 171.

This allows actuation fluid to flow from inlet 106, into the hollow interior 147 of the intensifier spool valve member 140, through radial openings 146, past the high pressure access seat 171, and into the intensifier control passage 109 to act upon the stepped top 155, 156 of the intensifier piston 150.

Thus, with the solenoid 130 energized, the closing hydraulic surface 167 of check valve member 160 is now exposed to a low pressure passage and the check valve member begins to behave like a simple check valve in that it will now open if fuel pressure within the nozzle chamber 114 is greater than a valve opening pressure sufficient to overcome return spring 165.

Hydraulically actuated fuel injectors with a direct-control check valve such as first generation HEUI-B™ unit injectors manufactured by Caterpillar Inc., an example of which is described above with reference to FIGS. 2–4, work very well. However, improvement to the actuation fluid control valve, a critical component that admits the high pressure actuating fluid to the injector, is desired.

This is because solenoid driven actuation fluid control valves utilizing a ball-and-pin arrangement such as described above can suffer a pressure capability problem when using very high pressure actuating fluid. In some cases, the solenoid force can be insufficient to overcome very high actuating fluid pressures. Other times, the solenoid force can be made strong enough, but the electrical energy necessary to operate the solenoid is high.

In the ball-and-pin design, when the pin attached to the armature moves down to push the ball to the lower seat when the solenoid is turned on, the solenoid force needs to overcome the rail pressure force pushing on the bottom surface of the ball. During injection the solenoid force has to hold the ball against the rail pressure.

After the solenoid is turned off the rail pressure pushes the ball to the upper seat and holds it there. Since the motion of the ball depends not only on the solenoid force, but also on the rail pressure which changes according to the operation conditions and also varies from shot-to-shot, the ball's motion is not stable from shot-to-shot and the time taken to move between the upper seat and lower seat varies with rail pressure. Dependence on rail pressure is a direct cause of poor stability, poor pressure capability, and high solenoid electric current.

Further, any misalignment in the ball-and-pin design could lead to structural failure resulting in significant lift and air-gap change, which in turn can lead to a significant change in injector performance. Additionally, there may be a stability problem caused by fluctuating actuation fluid pressure, leading to undesirable shot-to-shot variation in fuel delivery and timing.

Improvements in these and other areas, including check valve control response speed, check valve control response timing, reduction of noise, and stability at idle conditions, would also be advantageous.

Applicants' invention is directed to addressing one or more of these considerations.

DISCLOSURE OF THE INVENTION

An actuation fluid control valve for a hydraulically actuated fuel injector according to the invention comprises a valve body having an inlet seat, a bore having a bore axis and a bore wall, an actuation control cavity, a low pressure actuation fluid drain, an actuation fluid inlet for admitting high pressure actuation fluid to the bore from outside the fuel injector, an inlet seat at a border between the actuation control cavity and the bore, and a drain seat at a border between the actuation control cavity and the actuation fluid drain. An actuator is attached with the valve body. An actuation valve member is slidably disposed in the bore and has an inlet pin surface partially defining a fluid entry chamber within the bore. The actuation valve member is slidable in response to the actuator between a first position in which the actuation control cavity is open to the actuation fluid inlet via the fluid entry chamber and the actuation valve member is being held against the drain seat such that the actuation control cavity is fluidly isolated from the actuation fluid drain, and a second position in which the actuation control cavity is open to the actuation fluid drain and the actuation valve member is being held against the inlet seat such that the actuation control cavity is fluidly isolated from the actuation fluid inlet.

BRIEF DESCRIPTION OF THE DRAWINGS

For a better understanding of the invention reference may be made to the accompanying drawing figures, which are not necessarily to scale, in which some dimensions and/components may be exaggerated for illustrative purposes, and in which.

DETAILED DESCRIPTION

Figure 1:
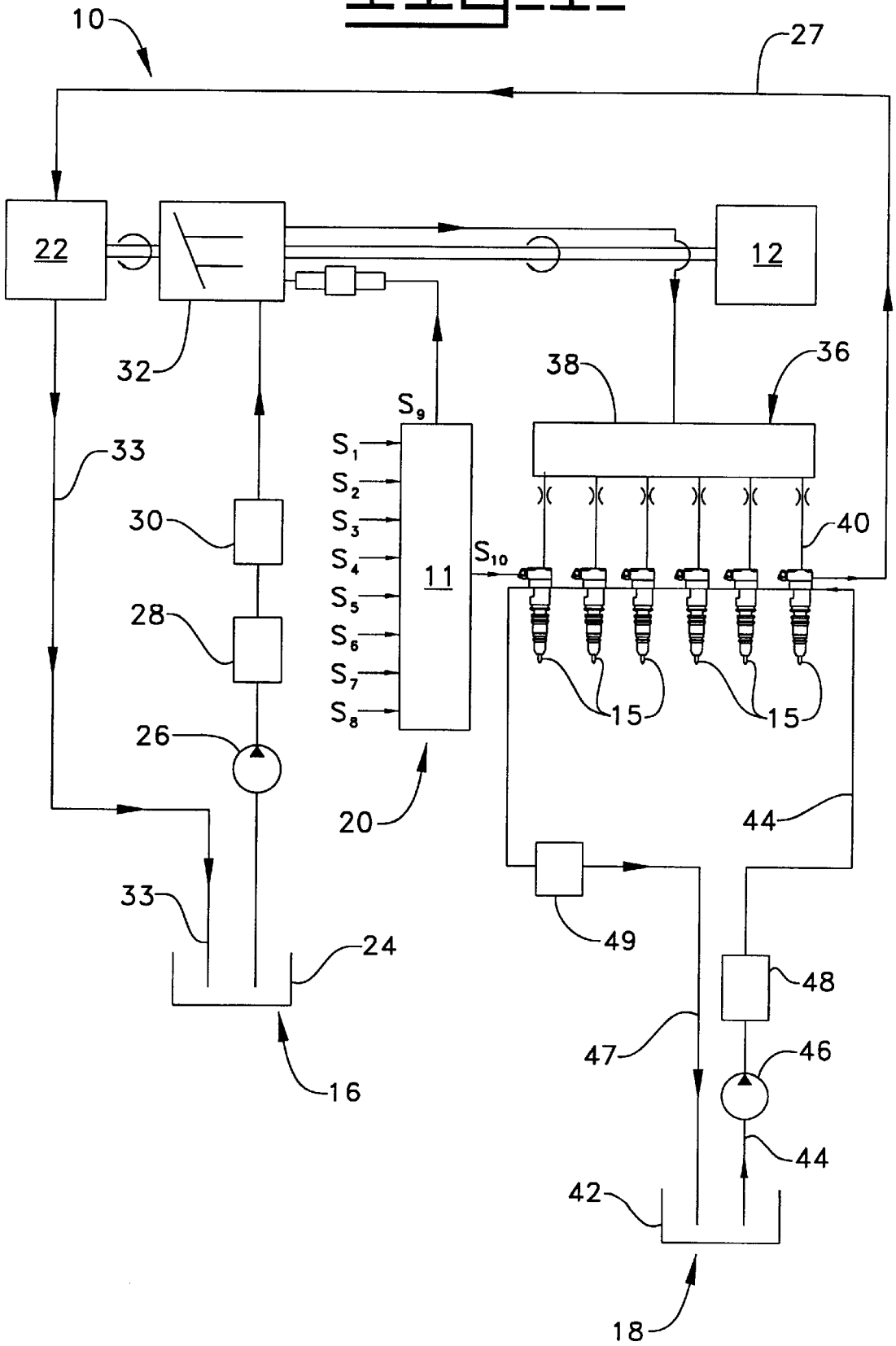
FIG. 1 a schematic view of a fuel injection system according to the present invention.

Referring now to FIG. 1, there is shown an embodiment of a hydraulically actuated electronically-controlled fuel injection system 10 in an example configuration as adapted for a direct-injection diesel-cycle internal combustion engine 12. Fuel system 10 includes one or more hydraulically actuated electronically-controlled fuel injectors 15, which are adapted to be positioned in a respective cylinder head bore of engine 12. Fuel system 10 includes an apparatus or means 16 for supply actuating fluid to each fuel injector 15, an apparatus or means 18 for supplying fuel to each injector, a computer 20 including an electronic control module 21 for electronically controlling the fuel injection system, and an apparatus or means 22 for re-circulating actuation fluid and for recovering hydraulic energy from the actuation fluid leaving each of the injectors.

The actuating fluid supply means 16 preferably includes the actuation fluid re-circulating means 22, an actuating fluid sump 24, a relatively low pressure actuating fluid transfer pump 26, a re-circulation line 27 that connects actuator fluid drains of the fuel injectors 15 with the re-circulating means 22, an actuating fluid cooler 28, one or more actuation fluid filters 30, a high pressure pump 32 for generating relatively high pressure in the actuation fluid, a re-circulation line 33 that connects the re-circulating means 22 with the actuating fluid supply means 16, and at least one relatively high pressure actuation fluid manifold 36. A common rail passage 38 is arranged in fluid communication with the outlet from the relatively high pressure actuation fluid pump 32. A rail branch passage 40 connects the actuation fluid inlet of each fuel injector 15 to the high pressure common rail passage 38.

Figure 2:
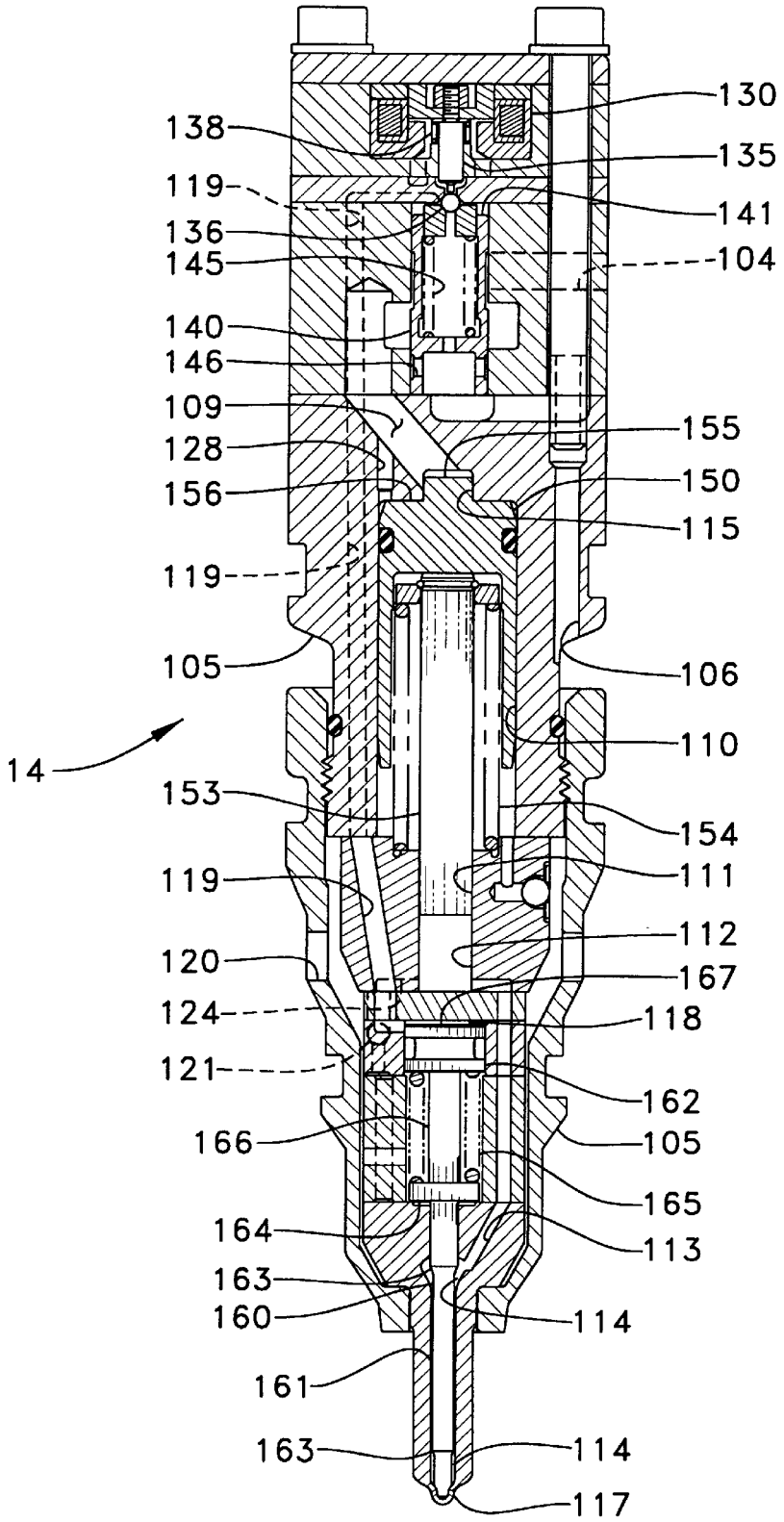
FIG. 2 is a sectioned side elevational view of a fuel injector having a direct-control check valve.

The fuel supply means 18 preferably includes a fuel tank 42, a fuel supply passage 44 arranged in fluid communication between fuel tank 42 and the fuel inlet 60 (FIG. 2) of each fuel injector 15, a relatively low pressure fuel transfer pump 46, one or more fuel filters 48, a fuel supply regulating valve 49, and a fuel circulation and return passage 47 arranged in fluid communication between fuel injectors 15 and fuel tank 42.

Figure 5:
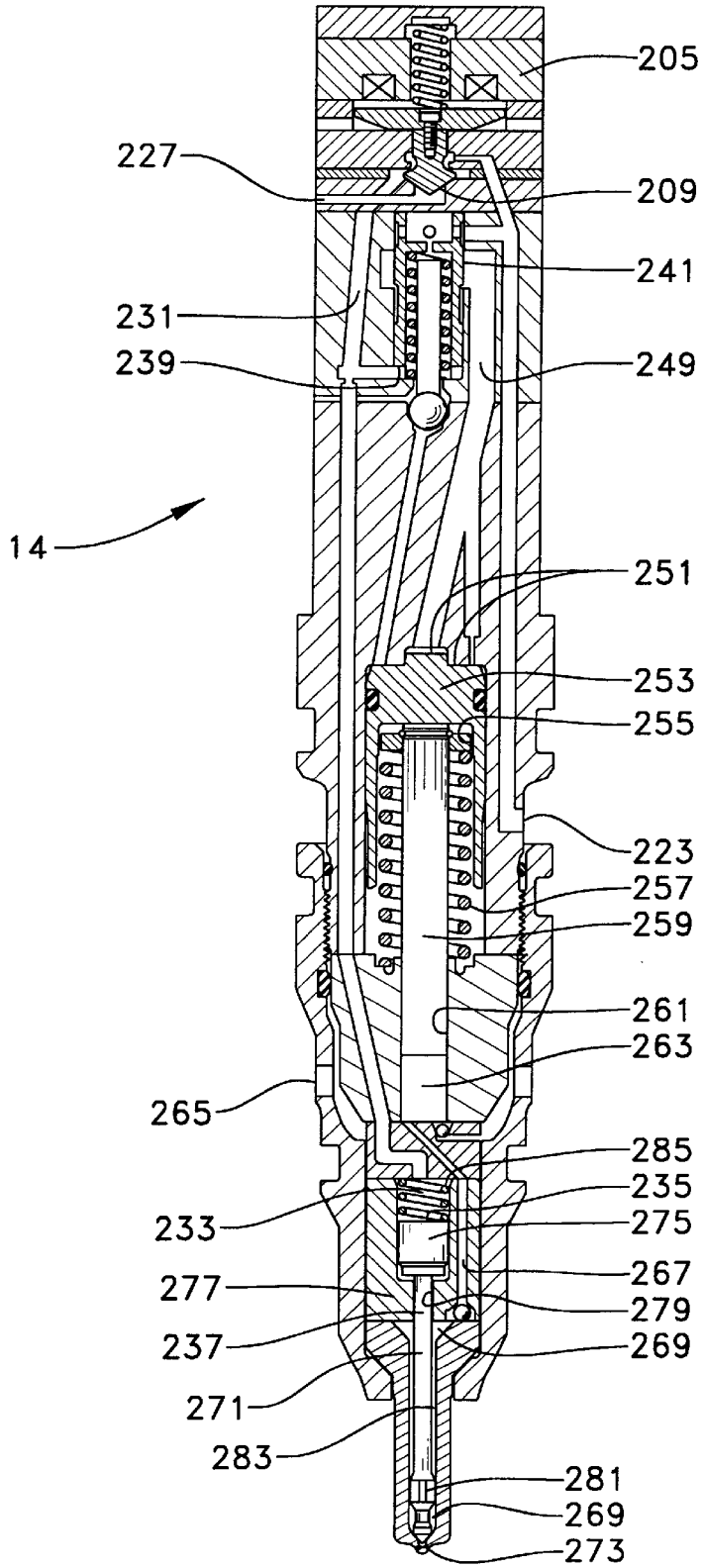
FIG. 5 is a sectioned side elevational view of an embodiment of a fuel injector according to the invention.
Figure 6:
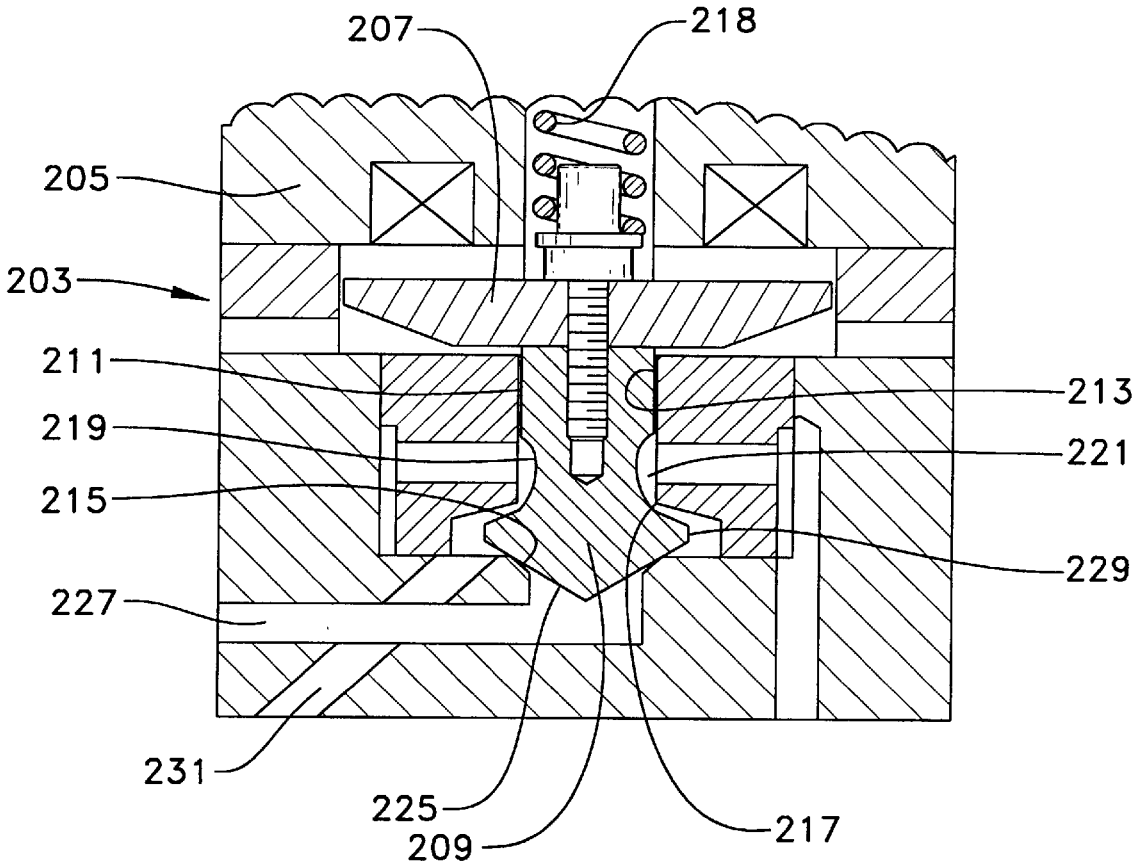
FIG. 6 is a partial sectioned side elevational view of an actuator portion of the fuel injector shown if FIG. 5.
Figure 7:
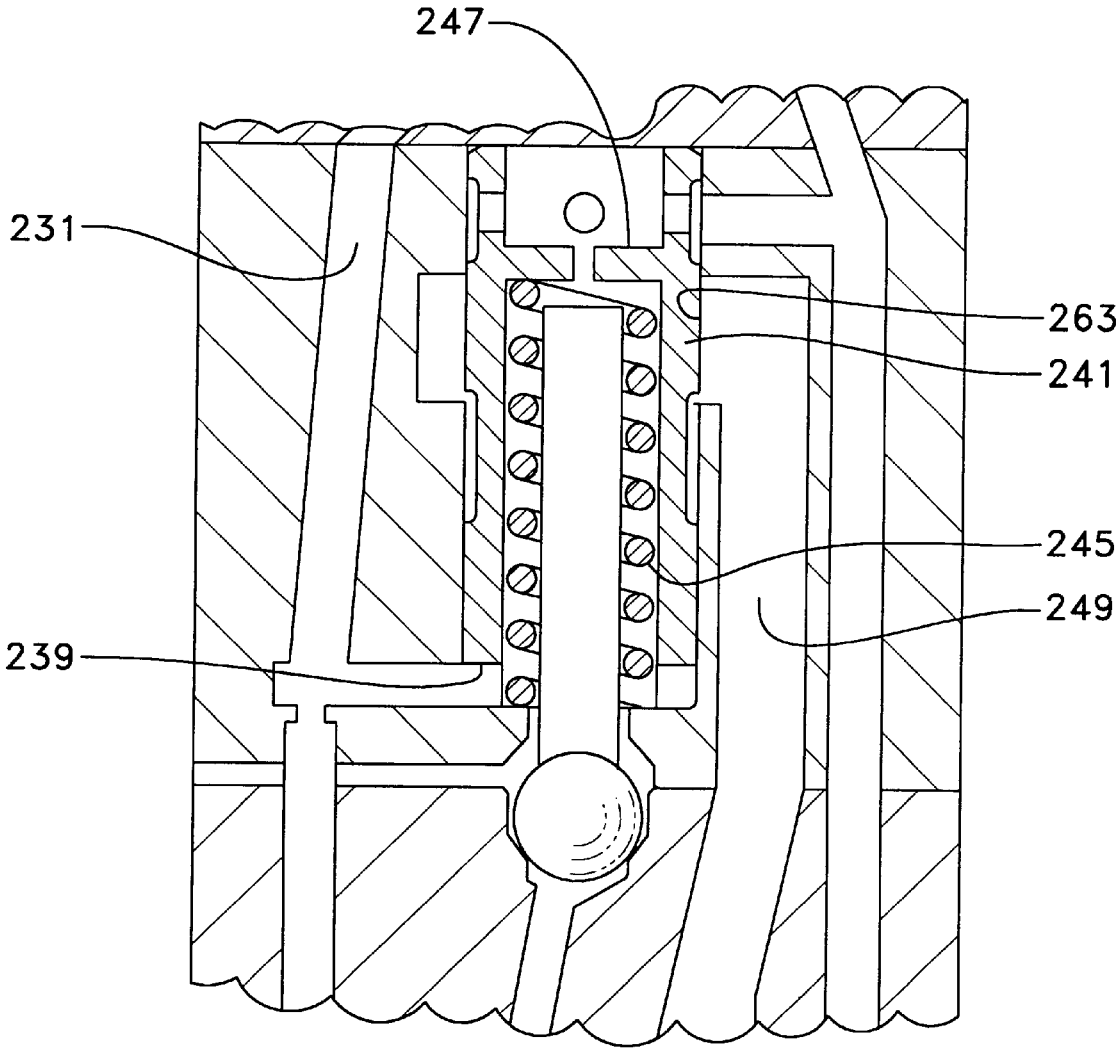
FIG. 7 is a partial sectioned side elevational view of a spool valve portion of the fuel injector shown in FIG. 5.

FIGS. 5–7 illustrate an embodiment of a fuel injector 15 having an actuation fluid control valve 203 according to the invention. This particular embodiment is adapted for a direct-injection diesel-cycle internal combustion engine, but the invention can be used in fuel injectors 15 in other types of engines as well. Fuel injectors 15 having the actuation fluid control valve 203 according to the invention can be used in fuel injection systems 10 such as the one illustrated in FIG. 1 and described above. The components and portions of the fuel injector 15 of this embodiment are described below with reference to FIGS. 5–7.

The fuel injector 15 of this embodiment utilizes a single attractive two-way solenoid actuator 205, although other embodiments utilizing the invention can make use of piezo stack or other types of actuators 205. The actuator 205 includes an armature 207 attached with an actuation valve member 209 slidably disposed in an actuator bore 211 having an actuator bore wall 213. The actuation valve member 209 is slidable between two positions. At a first position the actuation valve member 209 mates with a drain seat 215, and at the second position the actuation valve member 209 mates with an inlet seat 217. An actuator spring 220 biases the armature 207 and thus the attached actuation valve member 209 toward the first position.

The actuation valve member 209 has a substantially meniscus-shaped inlet pin surface 219 partially defining a fluid entry chamber 221 within the actuator bore 211. The fluid entry chamber 221 is fluidly connected with a source of high pressure actuation fluid that enters the fuel injector 15 through an actuation fluid inlet 223. The actuation valve member 209 also has a cone-shaped drain pin surface 225 exposed to a low pressure actuator fluid drain 227.

The actuation valve member 209 also has a central pin surface 229 that is exposed to a check control cavity 231 fluidly connected with a check control chamber 233 partially defined by a closing hydraulic surface 235 of a check valve member 237. The check control cavity 231 is also fluidly connected with a lower end hydraulic surface 239 of a spool valve member 241 slidably disposed in a spool valve bore 243. The spool valve member 241 is biased in an upward direction (relative to FIGS. 5–7) by a spool valve spring 245, and has an upper end hydraulic surface 247 on an end of the spool valve member 241 from the lower end hydraulic surface 239.

The spool valve member 241 partially defines an intensifier control passage 249 that is fluidly connected with a stepped top 251 of an intensifier piston 253 slidably disposed in a stepped piston bore 255. The intensifier piston 253 is upwardly biased by a plunger spring 257 that surrounds a plunger 259. The plunger 259 is slidably disposed in a plunger bore 261. A portion of the plunger 259 extends upward into the stepped piston bore 255.

Beneath the plunger 259 in the plunger bore 261 is a fuel pressurization chamber 263 fed by a supply of fuel that enters the fuel injector 15 through a fuel inlet 265. The fuel pressurization chamber 263 is fluidly connected via a connection passage 267 with a nozzle chamber 269 surrounding a lower check portion 271 of the check valve member 237. The nozzle chamber 269 comprises or more nozzle outlets 273 for allowing pressurized fuel to leave the fuel injector 15.

The check valve member 237 in this particular embodiment can be thought of as comprising generally the lower check portion 271 and an upper check portion 275. The lower check portion 271 is slidably disposed in a nozzle sleeve bore 279 of a nozzle sleeve 277, and extends into the nozzle chamber 269 wherein a lower check guide portion 281 of the lower check portion 271 is slidably disposed within a nozzle bore 283. Other embodiments of fuel injectors 15 utilizing the invention may lack a lower check guide portion.

The upper check portion 275 of the check valve member 237 comprises the closing hydraulic surface 235 and is slidably disposed within the check control chamber 233. The check valve member 237 is downwardly biased by a check spring 285 that is within the check control chamber 233 in this embodiment.

Figure 8A:
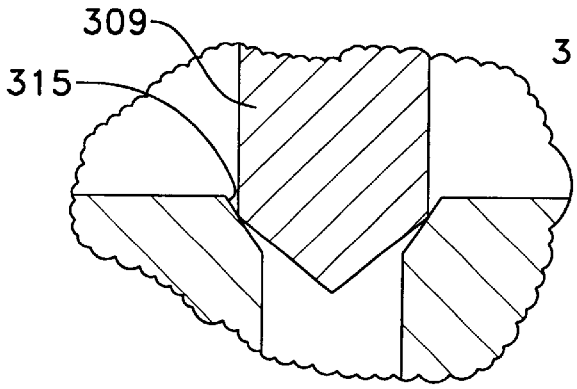
FIGS. 8A, 8B, 8C, and 8D illustrate different possible seating and pin configurations.
Figure 8B:
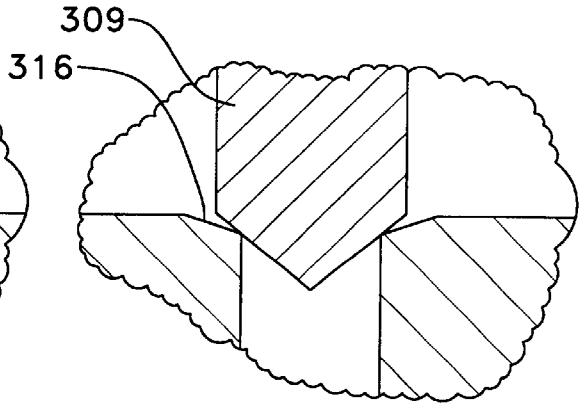

FIGS. 8A and 8B illustrate two different types of seating configurations. In FIG. 8A, an actuation valve member 309 seats with a drain seat 315 in an outside diameter (OD) seating configuration in which points of contact coincide with an outside diameter of the actuation valve member 309. In FIG. 8B, the actuation valve member 309 seats with a drain seat 316 in an inside diameter (ID) seating configuration in which the points of contact coincide with an inner diameter of the actuation valve member 309.

Figure 8C:
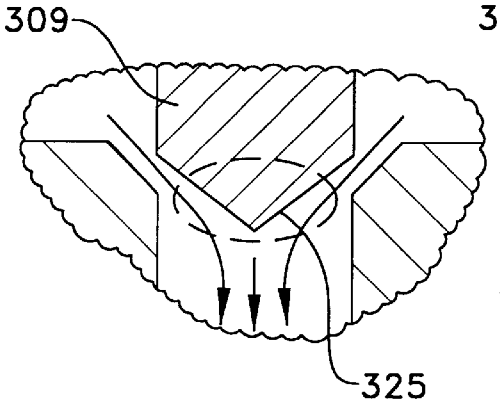

FIG. 8C illustrates hydraulic fluid flow past an actuation valve member 309 having a cone-shaped drain pin surface 325.

Figure 8D:
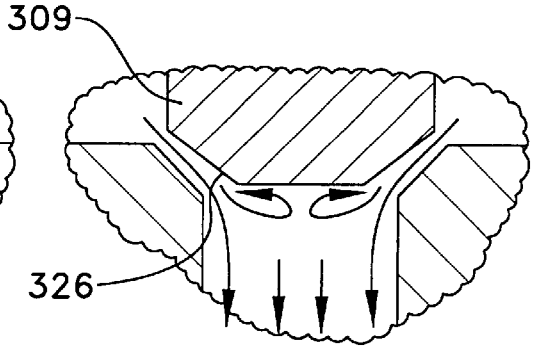

FIG. 8D illustrates hydraulic fluid flow past an actuation valve member 310 having a truncated drain pin surface 326.

Figure 9:
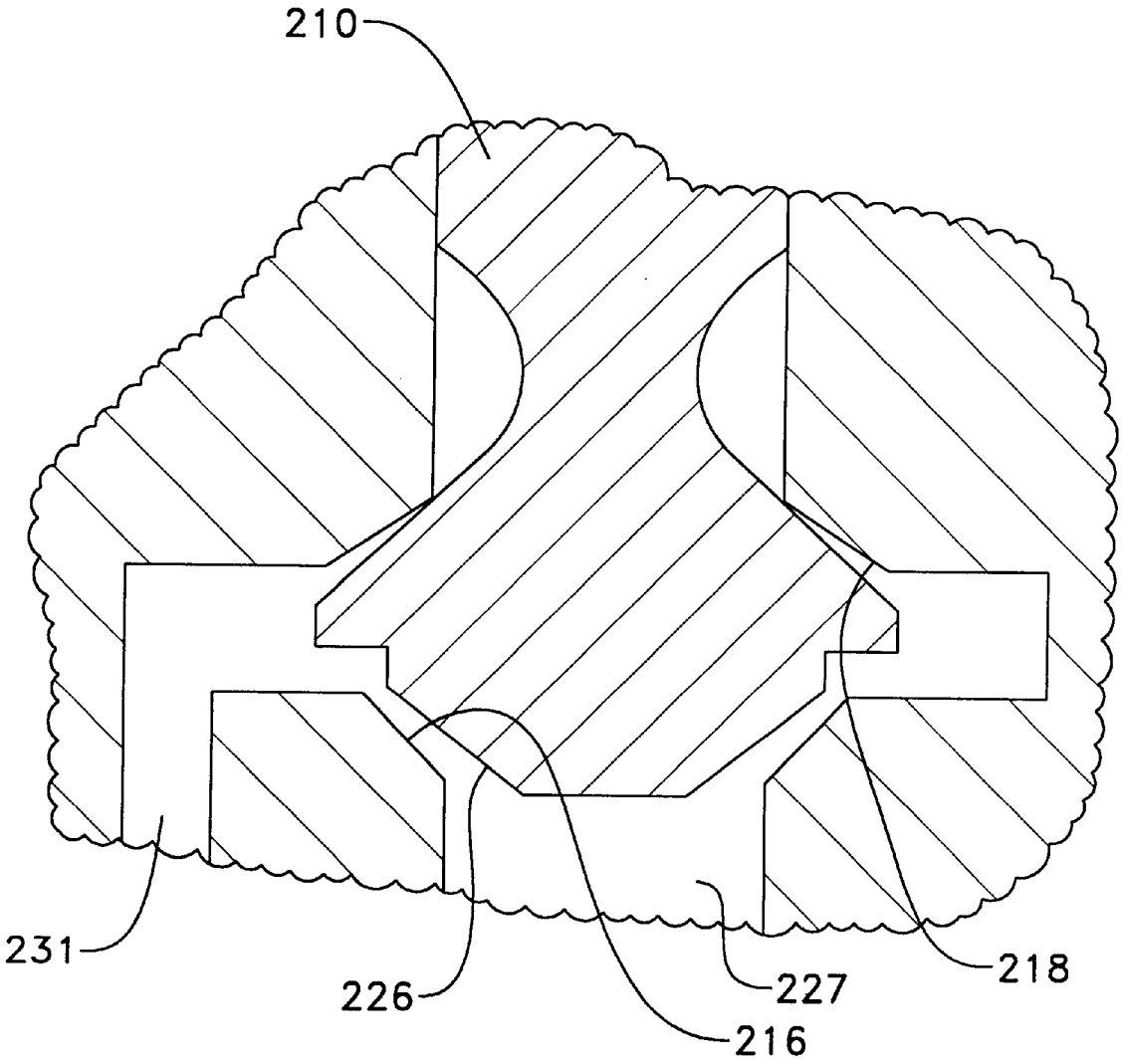
FIG. 9 illustrates seating configuration and pin configuration in another embodiment according to the invention.

FIG. 9 illustrates another embodiment of an actuation valve member 210 according to the invention, wherein the same element numbers are used as in FIG. 6 to label correspondingly similar elements. In contrast to the cone-shaped drain pin surface 225 shown in FIG. 6, the actuation valve member 210 of this embodiment has a flattened or truncated drain pin surface 226.

Industrial Applicability

The seated pin actuator valve according to the invention performs the same function has the ball-and-pin actuator valve, but there are several important differences. For one thing, the seated pin actuator valve is pressure balanced and therefore independent of rail pressure. For this reason motion of the armature and actuation valve member (pin) depends on the magnetic force and the spring force only. The repeatability of armature motion is insensitive to rail pressure variation from shot-to-shot, which is critical to improvement of injector stability, especially at idle condition.

The seated pin has smaller pin lift compared to the ball-and-pin design. Effective flow areas at open and closed positions are achieved with a sizable reduction in pin lift. Since the seated pin design eliminates the pre-ball travel (the distance the armature has to move before hitting the ball in order to overcome the rail pressure against the ball), the initial air-gap between the solenoid and the armature is significantly reduced.

The smaller pin lift reduces the pin's travel time between the upper and lower seats, and reduces the minimum dwell time for idle split injection. The smaller initial air-gap improves the solenoid force significantly, and the pull-in current and duration are significantly reduced.

Referring now to the hydraulically actuated electronically-controlled fuel injection system 10 shown in FIG. 1, the fuel injectors 15 receive high pressure actuation fluid from the actuation fluid supply means 16 via the pump 32 and the common rail 36. Actuation fluid leaving the actuation fluid drain of each fuel injector 15 enters the re-circulation line 27 that carries it to the hydraulic energy re-circulating or recovering means 22. A portion of the re-circulated actuation fluid is channeled to the high pressure actuation fluid pump 32 and another portion is returned to the actuation fluid sump 24 of the actuation fluid supply means 16 via the re-circulation line 33.

The fuel injectors 15 receive fuel from the fuel supply means 18 via the fuel supply passage 44, after the fuel has passed through the fuel transfer pump 46 and the fuel filters 48.

Any available engine fluid is preferably used as the actuation fluid in the present invention. However, in the preferred embodiments, the actuation fluid is engine lubricating oil and the actuation fluid sump 24 is the engine lubrication oil sump. This allows the fuel injection system 10 to be connected as a parasitic subsystem to the engine's lubricating oil circulation system. Alternatively, the actuation fluid could be fuel provided by the fuel tank 42 or another source, such as coolant fluid, etc.

The computer 20 preferably includes an electronic control module 11 which controls the fuel injection timing; the total fuel injection quantity during an injection cycle; the fuel injection pressure; the number of separate injections or injection segments during each injection cycle; the time intervals between the injection segments; the fuel quantity of each injection segment during an injection cycle; the actuation fluid pressure; any combination of the above parameters. The computer 20 receives a plurality of sensor input signals $S_1$–$S_8$ which correspond to known sensor inputs, such as engine operating condition, load, etc., that are used to determine the precise combination of injection parameters for the subsequent injection cycle. In this embodiment, computer 20 issues control signal $S_9$ to control the actuation fluid pressure and the control signal $S_{10}$ to control the fluid actuation fluid control valve(s) 203 within each fuel injector 15. Each of the injection parameters are variably controllable independent of engine speed and load. In the case of fuel injector 15, control signal $S_{10}$ is current to the actuator 205 commanded by the computer.

Operation of each fuel injector 15 is now described with reference to FIGS. 5–7. When the actuation valve member 209 is at the first position, the check control cavity 231 is in fluid communication with high pressure hydraulic fluid from the actuation fluid inlet 223, so that the high pressure actuating fluid pushes against the lower end hydraulic surface 239 of the spool valve member 241 to balance the force of the high pressure hydraulic fluid pushing down on the upper end hydraulic surface 247 of the spool valve member 241. As a result, the bias provided by the spool valve spring 245 keeps the spool valve member 241 positioned so that the intensifier control passage 249 is open to an actuator fluid drain 227.

Since there is only low pressure pushing down on the piston, the bias provided by the plunger spring 257 keeps the intensifier piston 253 from pressurizing fuel in the fuel pressurization chamber 263. Accordingly, there is only low pressure fuel in the nozzle chamber 269. Even without the force of hydraulic fluid pushing down on the closing hydraulic surface 235 of the check valve member 237, the bias provided by the check spring 285 is sufficient to keep the check valve member 237 pushed down so that it blocks fuel from reaching the nozzle outlets 273.

To start fuel injection, the actuator 205 is energized, pulling the armature 207 and also pulling the actuation valve member 209 to the second position. One desirable feature of this design is that the meniscus-shaped inlet pin surface 219 of the actuation valve member 209 largely eliminates horizontal surfaces of the actuation valve member 209 at the actuation fluid inlet 223. The lack of sharp corners in the fluid entry chamber 221 is conducive to smoother flow of the hydraulic fluid.

Additionally, with this design net forces on the actuation valve member 209 along its axis caused by the pressure of the high pressure actuation fluid are negligible. The reasons for this are twofold. First, since the high pressure actuation fluid enters the fluid entry chamber 221 from the side, the total upward horizontal surface area component of the inlet pin surface 215 equals the total downward horizontal surface area component of the inlet pin surface 215. Accordingly, the high pressure actuation fluid exerts no net force either upward or downward on the actuation valve member 209 when the actuation valve member 209 is at the second position and there is no fluid flowing through the fluid entry chamber 221, so that any hydraulic fluid in the fluid entry chamber 221 is essentially static.

Moreover, minimizing the horizontal components of the inlet pin surface 215 and tapering the inlet pin surface to adjust the width and/or depth of the fluid entry chamber 221 in a vertically symmetrical manner, for example as in the illustrated embodiment where the fluid entry chamber 221 has a very small depth both at its top and at its bottom, creates a vertical symmetry of velocity of the high pressure hydraulic fluid flowing through the fluid entry chamber 221 when the actuation valve member 209 is at the first position and fluid is flowing through the fluid entry chamber 221 past the inlet seat 217. As is understood in the science of fluid dynamics, a vertical symmetry of fluid velocity can keep an additional net vertical force from being introduced due to variations in hydraulic fluid pressure caused by velocity of the hydraulic fluid.

Figure 3:
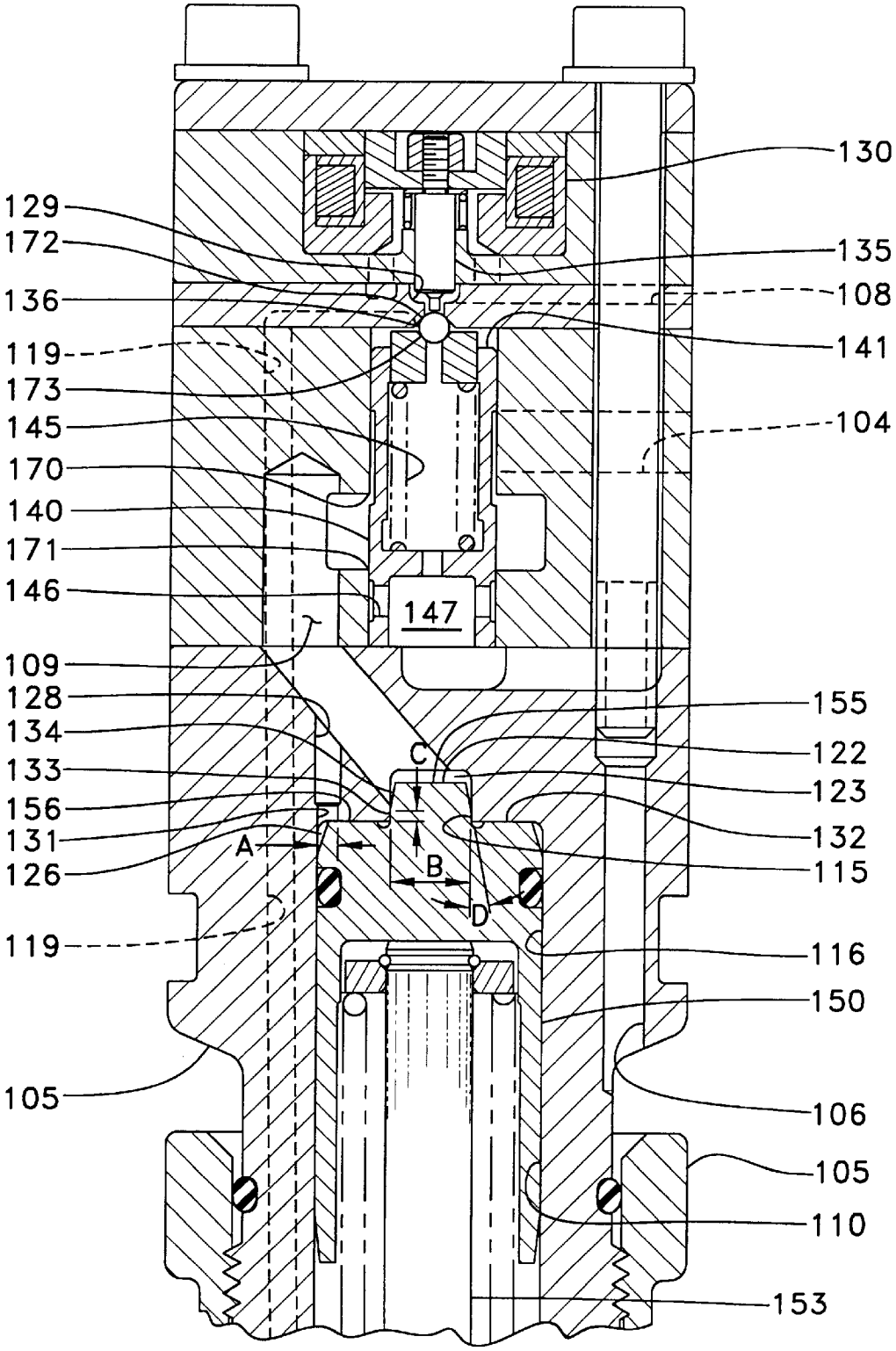
FIG. 3 is a partial sectioned side elevational view of an upper portion of the fuel injector shown in FIG. 2.
Figure 4:
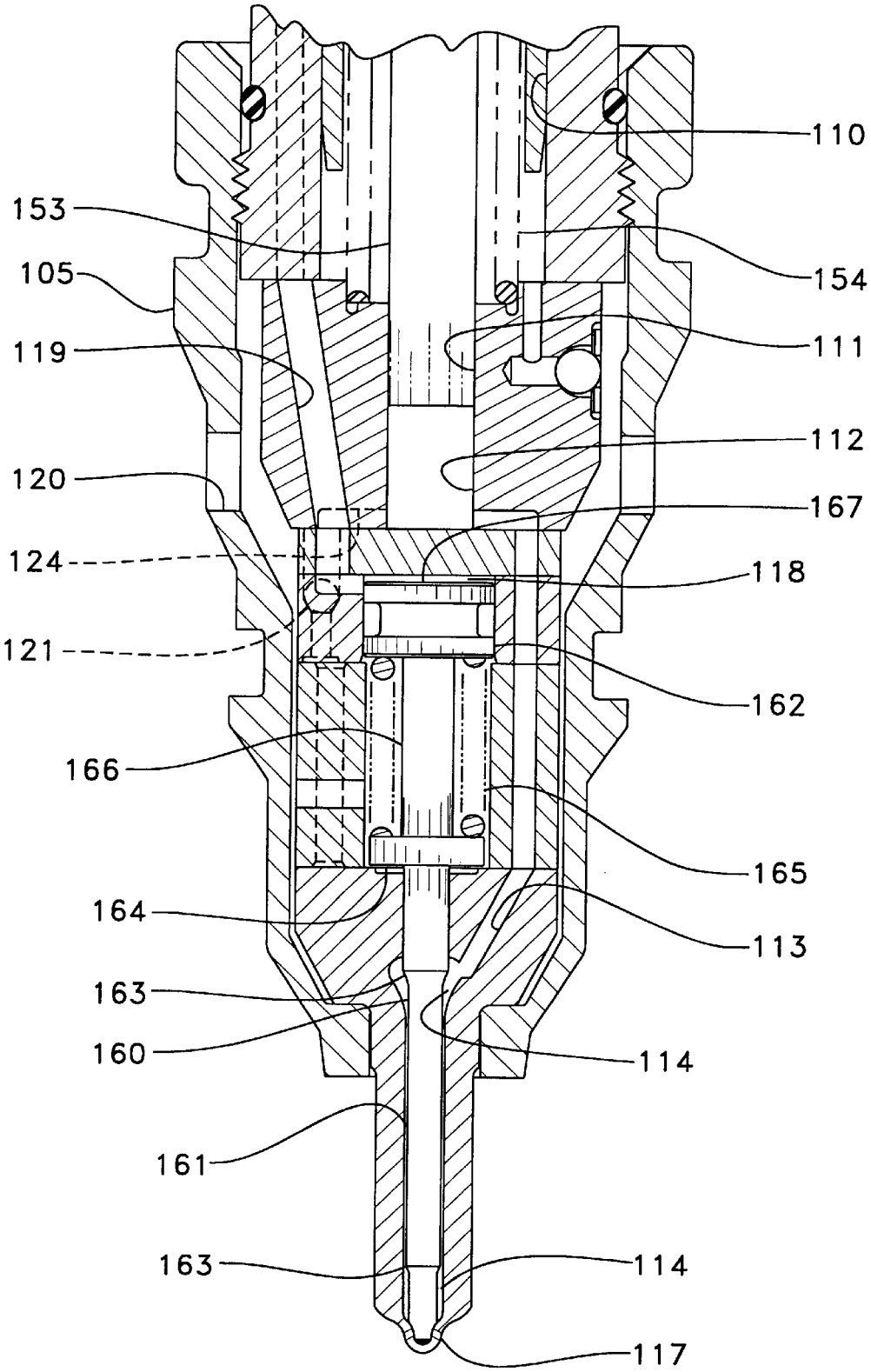
FIG. 4 is a partial sectioned side elevational view of a lower portion of the injector shown in FIG. 2.

This pressure-balanced design results in much reduced shot-to-shot variation in fuel delivery and timing over previous designs because the actuation valve member 209 moving forces are essentially independent of variations in actuation fluid pressure. Additionally, much less electrical energy is required of the actuator 205, compared with designs such as that shown in FIGS. 2–4, where the actuator 205 must push against the force of high pressure actuation fluid. There is also faster check valve control response and reduction of noise over previous designs, at least in part due to the relatively small mass of the seated pin actuation valve member 209.

When the actuation valve member 209 is at the second position, high pressure actuation fluid from the actuation fluid inlet 223 is blocked from reaching the check control cavity 231 and the lower end hydraulic surface 239 of the spool valve member 241. At the same time, the second position of the actuation valve member 209 opens the check control cavity 231 to the low pressure actuator fluid drain 227.

However, high pressure actuation fluid is still pushing on the upper end hydraulic surface 247 of the spool valve member 241. Since there is now only low pressure pushing against the lower end hydraulic surface 239 of the spool valve member 241, the force of the hydraulic fluid on the upper end hydraulic surface 247 is sufficient to overcome the bias provided by the spool valve spring 245. As a result the spool valve member 241 moves down to close off the intensifier control passage 249 from the actuator fluid drain 227 while opening the intensifier control passage 249 to the high pressure actuation fluid from the actuation fluid inlet 223, which pushes down on the intensifier piston 253 with a force great enough to overcome the bias provided by the plunger spring 257.

Pushed down by the force of the high pressure actuation fluid, the intensifier piston 253 pushes the plunger 259 down, pressurizing fuel in the fuel pressurization chamber 263. The pressurized fuel flows through the connection passage 267 to the nozzle chamber 269. Since there is now only low pressure against the closing hydraulic surface 235 of the check valve member 237, the force provided by the pressurized fuel in the nozzle chamber 269 is sufficient to overcome the bias provided by the check spring 285. As a result the check valve member 237 moves up, allowing highly pressurized fuel to exit the fuel injector 15, into the engine combustion chamber for example.

To terminate fuel injection the actuator 205 is de-energized, allowing the actuator spring 216 to move the actuation valve member 209 back to the first position. In this position the check control cavity 231 is closed off from the actuator fluid drain 227, and is fluidly connected to the high pressure actuation fluid from the actuation fluid inlet 223. This causes high pressure actuation fluid to be applied to the lower end hydraulic surface 239 of the spool valve member 241, once again balancing the force of the high pressure actuation fluid against the upper end hydraulic surface 247 of the spool valve member 241.

The bias provided by the spool valve spring 245 can now move the spool valve member 241 upward to cut off the supply of high pressure actuation fluid from the intensifier control passage 249 and to relieve the pressure in the intensifier control passage 249 by exposing it to the actuator fluid drain 227. The bias provided by the plunger spring 257 is now able to push the intensifier piston 253 upward. This reduces the pressure of the fuel in the fuel pressurization chamber 263, and hence in the nozzle chamber 269, allowing the bias provided by the check spring 285 to push the check valve member 237 toward its closed position.

However, it takes some time for the high pressure actuation fluid to move the spool valve member 241 and then to push down the intensifier piston 253. The high pressure actuation fluid in the check control cavity 231 reaches the check control chamber 233 and acts upon the low mass check valve member 237 much more quickly. Even though the nozzle chamber 269 still contains highly pressurized fuel, the combination of the increased pressure in the check control chamber 233 and the bias provided by the check spring 285 overcomes the pressure of the fuel in the nozzle chamber 269. This causes the check valve member 237 to shut immediately, providing a much more abrupt end to the injection cycle than can be obtained otherwise.

Additionally, because of the hysteresis affect of the relative delay of the spool valve member 241, even before the spool valve member 241 can move upward enough to shut off the supply of high pressure actuation fluid from the intensifier control passage 249 the actuator 205 can be turned rapidly on and off to directly control the check valve member 237 by acting on its closing hydraulic surface 235. Doing this can make the check valve member 237 open and close as many times as desired at any time during the injection cycle. For example, this feature can be used to cause a short delay after a "pilot" fuel injection at the beginning of an injection cycle in order to reduce engine emissions or for other reasons.

Choice of seating configuration is a very important for performance of the injector 10 for controlling fuel growth over the lifetime of the fuel injector. For any poppet valve there are two types of the seating configurations as explained above: OD (FIG. 8A) and ID (FIG. 8B). Choice of the seating configuration affects growth direction of sealing length (width of the annulus of actual contact between the pin and a seat) as wear occurs at the contact areas. For the OD seated valve the sealing length grows toward the center of the valve. For the ID seated valve the sealing length grows away from the center.

Selection of seating configuration in the illustrated embodiments is based on consideration of the actual operating conditions of the valve and control of sealing length growth over time. It will be understood that pressure against valve components at the seats (when closed) will vary with the seating diameter, defined by the upstream contact point between the pin and a respective seat when that seat is closed. For the illustrated embodiments the inlet seat 217, 218 is ID seated and the drain seat 215, 216 is OD seated, as is most clearly illustrated in FIG. 9.

The inlet seat 217, 218 is ID seated for two reasons; the inlet seat 217, 218 must be pressure balanced when the pin is at the second position, and growth of the seating diameter must not significantly affect movement of the pin. The seating diameter of the inlet seat 217, 218 is the same as the diameter of the actuator bore 211. If the inlet seat 217, 218 were OD seated, then the seating diameter would be larger than the diameter of the actuator bore 211 and the seating diameter would change with seat wear.

A difference between the seating diameter and the actuator bore diameter would cause the fluid entry chamber 221 to be unbalanced with respect to rail pressure. The resultant force of this imbalance would be downward. Therefore at high rail pressure the solenoid hold-in current would have to be made higher to generate enough magnetic force to overcome the unbalanced force and the armature spring load. Additionally, this would affect timing, etc. due to variations in rail pressure, as explained above.

The drain seat 215, 216 is OD seated so that the sealing length grows toward the center of the valve, which will not change the seating diameter at the drain seat 215, 216. The inlet seat 217, 218 seating diameter and the drain seat 215, 216 seating diameter should have been chosen to pressure balance the valve. If the lower seat were ID seated, the sealing length would grow away from the center, and the seating diameter would grow larger with time, disrupting the balance between the upper seat and lower seat seating diameters and requiring a higher solenoid pull-in current.

The cone-shaped drain pin surface 225 of the actuation valve member 209 results in a smooth flow of hydraulic fluid. This is illustrated in FIG. 8C for a representative actuation valve member 309 having a cone-shaped drain pin surface 325. The flow is smooth and there is no separation flow current. The pressure profile on the drain pin surface 225, 325 is linearly decreasing, and the resulting force on the actuation valve member 209, 309 is a significant part of the flow force.

Even though the drain area is large, the flow force does not reduce because the flow forms a stagnation zone, represented by the dashed oval. The pressure in this zone is always higher than the atmospheric pressure, which causes a significant flow force acting upon the drain pin surface 225, 325. Although small, it is important to eliminate this force if possible in order to reduce the bias required of the actuator spring 220, because the larger the actuator spring 220 bias, the larger the pull-in force required of the actuator.

Eliminating this unbalancing flow force can be accomplished by using a truncated drain pin surface 226, which changes the flow characteristics for the actuation valve member 210. This is illustrated in FIG. 8D for a representative actuation valve member 310 having a truncated drain pin surface 326. In this configuration, the flow separates after passing the seat and forms a low-pressure separation flow zone. The pressure in this zone is close to the atmospheric pressure and it does not create significant flow force acting on the truncated drain pin surface 226, 326.

The seated-pin actuator described herein and implemented in Caterpillar's HEUI-B™ fuel injector results in a hydraulically actuated fuel injector having better stability, full injection rate shaping capability, lower electric energy consumption, and the higher pressure capability.

It should be understood that the above description is intended only to illustrate the concepts of the present invention, and is not intended to in any way limit the potential scope of the present invention. For example, the actuation fluid control valve 203 of the invention is shown in a HEUI-B™ type fuel injector manufactured by Caterpillar Inc. and can be incorporated in other HEUI™ models as well. However, the actuation fluid control valve 203 of the invention can be adapted for use in any hydraulically actuated fuel injector, or in other hydraulically actuated devices such as hydraulic engine brake actuators for example, and other hydraulic control devices of moveable.

Additionally, while the present invention is shown including a hydraulic system attached to the engine that utilizes lubricating oil as actuation fluid, this could be modified. For instance, the hydraulic system could be isolated from the engine and could use a separate fluid as actuation fluid, or the hydraulic system could be isolated from the engine while still using the lubricating oil as actuation fluid. Thus, various modifications could be made without departing from the intended spirit and scope of the invention as defined by the claims below.

We claim:

1. An actuation fluid control valve for a hydraulically actuated fuel injector, comprising:

a valve body including a bore having a bore axis and a bore wall, an actuation control cavity, a low pressure actuation fluid drain, an actuation fluid inlet for admitting high pressure actuation fluid to the bore from outside the fuel injector, an inlet seat at a border between the actuation control cavity and the bore, and a drain seat at a border between the actuation control cavity and the actuation fluid drain;

an actuator attached with the valve body; and an actuation valve member slidably disposed in the bore, the actuation valve member having an inlet pin surface partially defining a fluid entry chamber within the bore, the actuation valve member being slidable in response to the actuator between:

a first position in which the actuation control cavity is open to the actuation fluid inlet via the fluid entry chamber and the actuation valve member is being held against the drain seat such that the actuation control cavity is fluidly isolated from the actuation fluid drain; and a second position in which the actuation control cavity is open to the actuation fluid drain and the actuation valve member is being held against the inlet seat such that the actuation control cavity is fluidly isolated from the actuation fluid inlet.

2. The actuation fluid control valve of claim 1, wherein the inlet pin surface is meniscus-shaped and tapered such that the fluid entry chamber is substantially vertically symmetrical.

3. The actuation fluid control valve of claim 2, wherein the actuator comprises a solenoid.

4. The actuation fluid control valve of claim 3, wherein the actuation valve member comprises a pin attached with an armature.

5. The actuation fluid control valve of claim 2, where the actuator comprises a piezo stack.

6. The actuation fluid control valve of claim 2, the actuation valve member and the drain seat configured such that when the actuation valve member is at the first position the actuation valve member is being held against the drain seat in an OD seating configuration; and the actuation valve member and the inlet seat configured such that when the actuation valve member is at the second position the actuation valve member is being held against the inlet seat in an ID seating configuration.

7. The actuation fluid control valve of claim 2, the actuation valve member further comprising a truncated drain pin surface partially defining the actuation fluid drain when the actuation valve member is at the first position.

8. A fuel injector having an actuation fluid control valve, the actuation fluid control valve comprising:

a valve body including a bore having a bore axis and a bore wall, an actuation control cavity, a low pressure actuation fluid drain, an actuation fluid inlet for admitting high pressure actuation fluid to the bore from outside the fuel injector, an inlet seat at a border between the actuation control cavity and the bore, and a drain seat at a border between the actuation control cavity and the actuation fluid drain;

an actuator attached with the valve body; and an actuation valve member slidably disposed in the bore, the actuation valve member having an inlet pin surface partially defining a fluid entry chamber within the bore, the actuation valve member being slidable in response to the actuator between:

a first position in which the actuation control cavity is open to the actuation fluid inlet via the fluid entry chamber and the actuation valve member is being held against the drain seat such that the actuation control cavity is fluidly isolated from the actuation fluid drain; and a second position in which the actuation control cavity is open to the actuation fluid drain and the actuation valve member is being held against the inlet seat such that the actuation control cavity is fluidly isolated from the actuation fluid inlet.

9. The fuel injector of claim 8, wherein the inlet pin surface is meniscus-shaped and tapered such that the fluid entry chamber is substantially vertically symmetrical.

10. The fuel injector of claim 9, wherein the actuator comprises a solenoid.

11. The fuel injector of claim 10, wherein the actuation valve member comprises a pin attached with an armature.

12. The fuel injector of claim 9, where the actuator comprises a piezo stack.

13. The fuel injector of claim 9, the actuation valve member and the drain seat configured such that when the actuation valve member is at the first position the actuation valve member is being held against the drain seat in an OD seating configuration; and the actuation valve member and the inlet seat configured such that when the actuation valve member is at the second position the actuation valve member is being held against the inlet seat in an ID seating configuration.

14. The fuel injector of claim 9, the actuation valve member further comprising a truncated drain pin surface partially defining the actuation fluid drain when the actuation valve member is at the first position.

15. A fuel injector having an actuation fluid control valve, the actuation fluid control valve comprising:

a valve body including a bore having a bore axis and a bore wall, an actuation control cavity, a low pressure actuation fluid drain, an actuation fluid inlet for admitting high pressure actuation fluid to the bore from outside the fuel injector, an inlet seat at a border between the actuation control cavity and the bore, and a drain seat at a border between the actuation control cavity and the actuation fluid drain;

an actuator attached with the valve body; and an actuation valve member slidably disposed in the bore, the actuation valve member having an inlet pin surface partially defining a fluid entry chamber within the bore, the inlet pin surface comprising means for keeping net vertical force on the actuation valve member substantially independent of pressure of the high pressure actuation fluid, the actuation valve member being slidable in response to the actuator between:

a first position in which the actuation control cavity is open to the actuation fluid inlet via the fluid entry chamber and the actuation valve member is being held against the drain seat such that the actuation control cavity is fluidly isolated from the actuation fluid drain; and a second position in which the actuation control cavity is open to the actuation fluid drain and the actuation valve member is being held against the inlet seat such that the actuation control cavity is fluidly isolated from the actuation fluid inlet.

16. The fuel injector of claim 15, wherein the actuator comprises a solenoid.

17. The fuel injector of claim 16, wherein the actuation valve member comprises a pin attached with an armature.

18. The fuel injector of claim 15, where the actuator comprises a piezo stack.

19. The fuel injector of claim 15, the actuation valve member and the drain seat configured such that when the actuation valve member is at the first position the actuation valve member is being held against the drain seat in an OD seating configuration; and the actuation valve member and the inlet seat configured such that when the actuation valve member is at the second position the actuation valve member is being held against the inlet seat in an ID seating configuration.

20. The fuel injector of claim 15, the actuation valve member further comprising a truncated drain pin surface partially defining the actuation fluid drain when the actuation valve member is at the first position.

21. A fuel injector comprising:

an injector body including a first valve seat and a second valve seat, and defining a high pressure passage, a low pressure passage, a check control chamber and a nozzle outlet an electrical actuator attached to said injector body and including a movable portion;

an actuation valve member trapped to move between said first valve seat and said second valve seat and being operably coupled to move with said movable portion of said electrical actuator, and having a first position at which said check control chamber is fluidly connected to said high pressure passage, and a second position at which said check control chamber is fluidly connected to said low pressure passage; and a check valve member at least partially positioned in said injector body and including a closing hydraulic surface exposed to fluid pressure in said check control chamber, and being movable between an open position at which said nozzle outlet is open, and a closed position at which said nozzle outlet is blocked.

* * * * *